United States Patent [19]

Booth

[11] Patent Number: 4,459,791

[45] Date of Patent: Jul. 17, 1984

[54] TELESCOPING BOX ASSEMBLY

[75] Inventor: John L. Booth, Vero Beach, Fla.

[73] Assignee: Booth Manufacturing Company, Fort Pierce, Fla.

[21] Appl. No.: 315,365

[22] Filed: Oct. 27, 1981

[51] Int. Cl.[3] ..... B65B 7/28

[52] U.S. Cl. ..... 53/290; 53/312; 53/321; 53/322

[58] Field of Search ..... 53/294, 290, 309, 310, 53/312, 321, 322, 324, 367

[56] References Cited

U.S. PATENT DOCUMENTS

| | | | |
|---|---|---|---|
| 1,080,277 | 12/1913 | Harbeck | 53/294 |
| 1,511,966 | 10/1924 | Hewit | 53/294 |
| 2,255,251 | 9/1941 | Guyer | 53/485 X |
| 2,850,858 | 9/1958 | Daly et al. | 53/367 X |
| 3,810,345 | 5/1974 | Lemmond et al. | 53/367 X |

FOREIGN PATENT DOCUMENTS

| | | | |
|---|---|---|---|
| 505990 | 8/1930 | Fed. Rep. of Germany | 53/307 |
| 24962 | 8/1931 | Netherlands | 53/294 |
| 189378 | 2/1937 | Switzerland | 53/294 |
| 564706 | 10/1944 | United Kingdom | 53/294 |

*Primary Examiner*—Horace M. Culver

*Attorney, Agent, or Firm*—Dressler, Goldsmith, Shore, Sutker & Milnamow, Ltd.

[57] ABSTRACT

An assembly in which a loaded container is covered with a box top in telescoping relationship with the loaded container. The box top is pressed over the loaded container and during the telescoping action is held in telescoping relationship by means of a spreader assembly that contacts the internal wall of the box top and the external wall of the loaded container, so that the box top can be telescopingly applied when being loaded over the container.

5 Claims, 17 Drawing Figures

FIG. 4
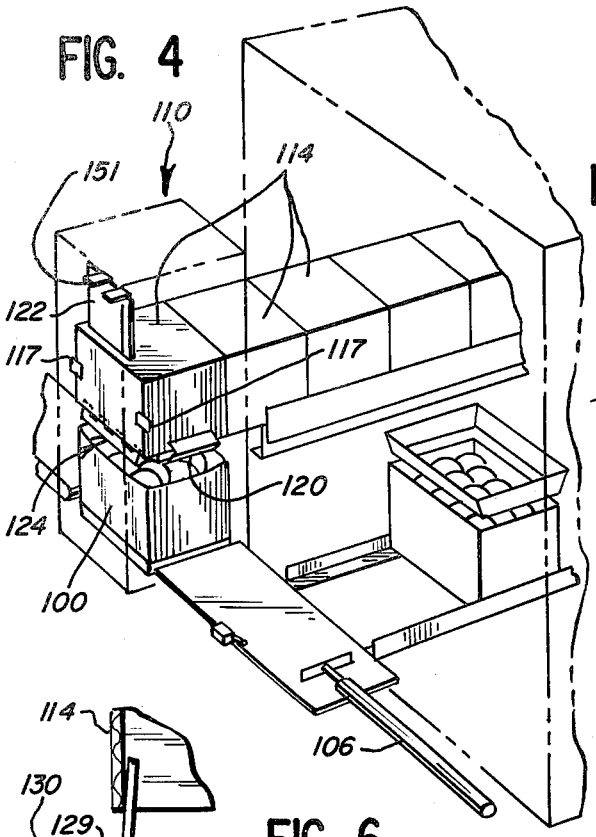
FIG. 5
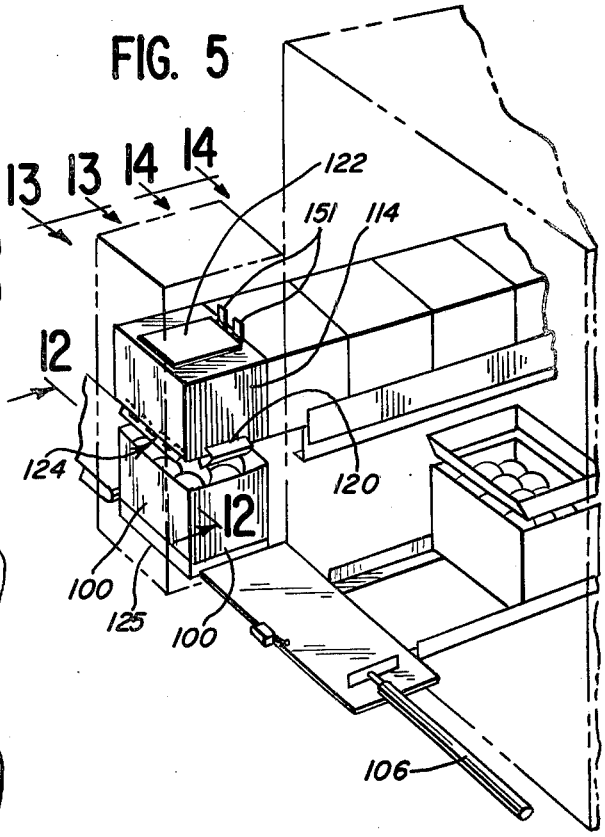
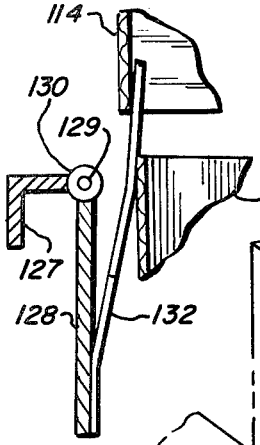
FIG. 6
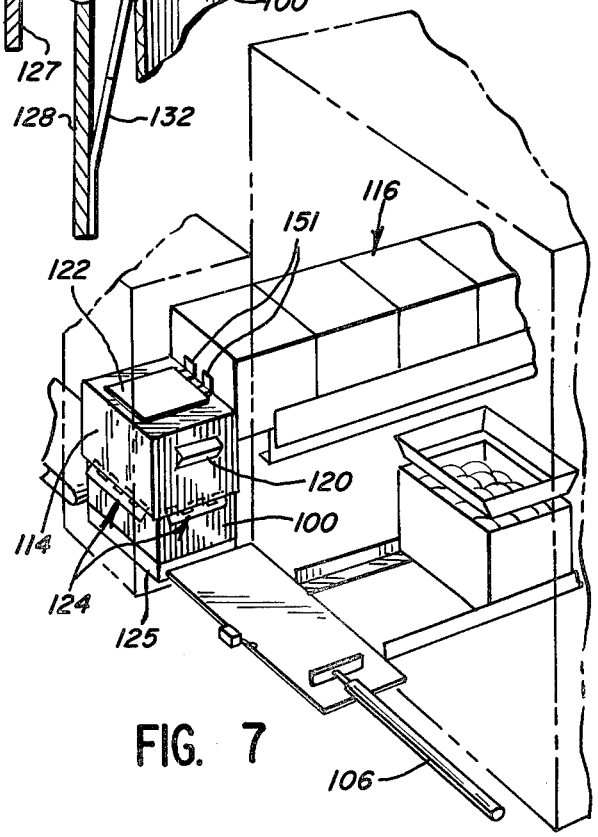
FIG. 7
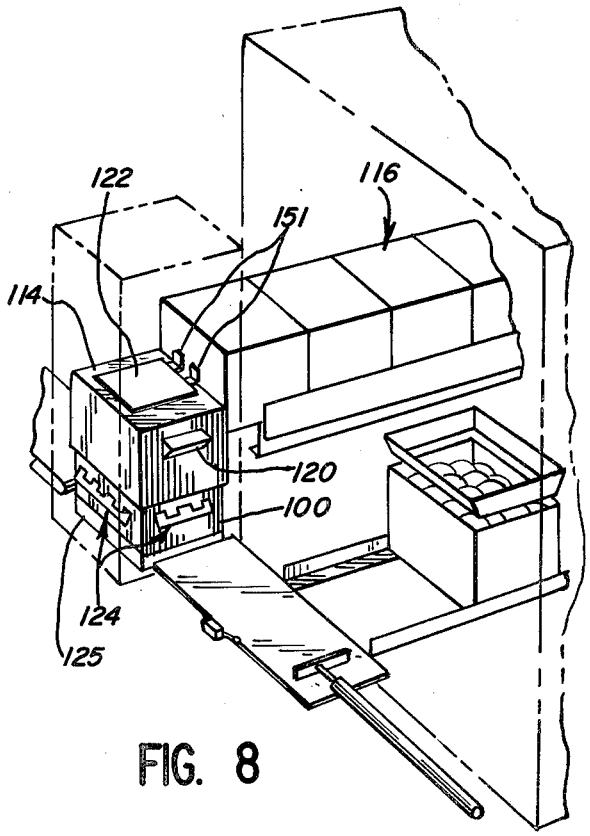
FIG. 8

FIG. 9
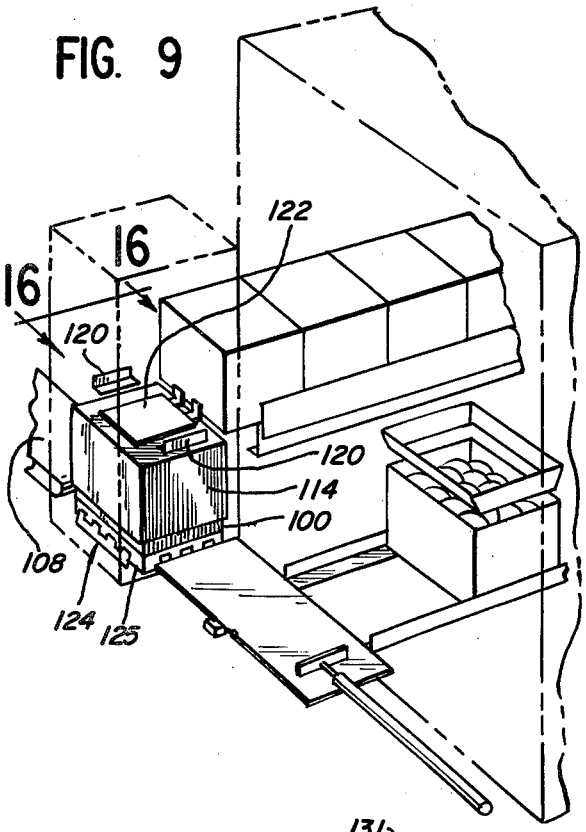
FIG. 10
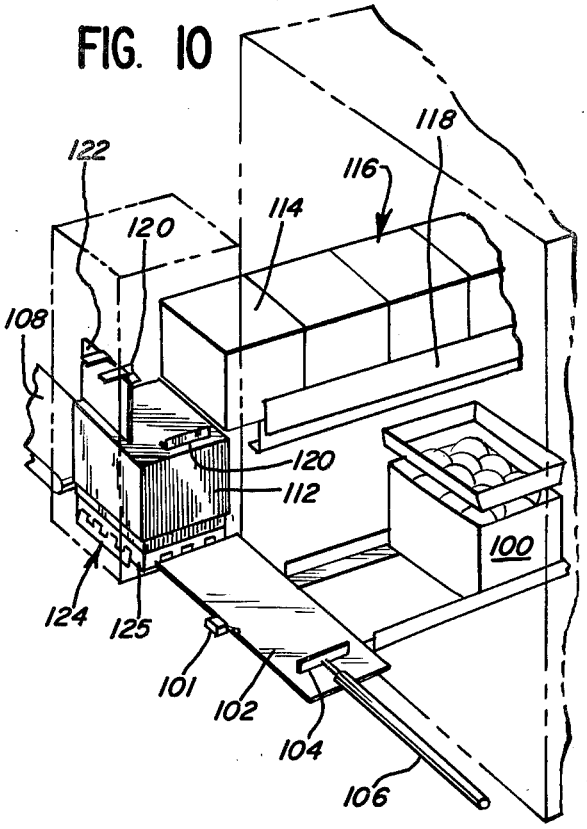
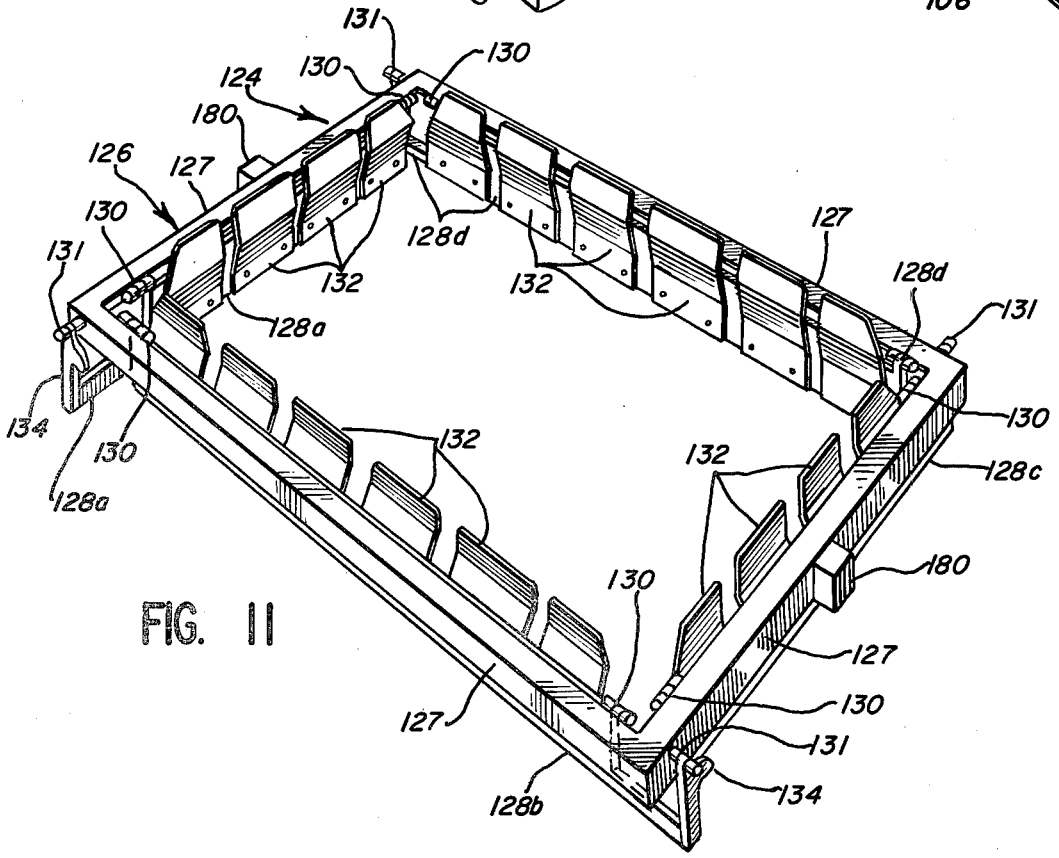
FIG. 11

142
150
122
144
144
144
148
123
184
186
117
145
164
159
172
162
140
120
121
132
132
160
182
180
127
127
134
166
180
158
156
128b
148
158
146

TELESCOPING BOX ASSEMBLY

This invention relates to an apparatus for telescopingly placing a box top over a loaded container. In the art of automatically packaging fruit, or similar articles, it is the practice to load a container with fruit and then by hand take a box top and telescopingly dispose it over the loaded container. This arrangement has been cumbersome, and, needless to say, very expensive and a stumbling block in an otherwise automatic procedure for encapsulating a box full of loaded articles. It can be appreciated that where box tops that are comparable in size to the size of the boxes they are to enclose are particularly difficult to fit, since the loaded container to be covered will by its very nature be distorted during the filling process. Box tops of such configuration are particularly useful, since they aid in strengthening the loaded container. The use of box tops having a depth almost equal to the box bottom are in common usage in many industries today and providing the novel apparatus disclosed herein is a boon to the industry. However, it can be appreciated that the instant invention is not limited to use with a box top having a particular depth, but is useful in telescoping a box top of any depth onto a loaded container.

In accordance with a present invention, there is provided a mechanism which places a loaded container into a station where a box top is automatically telescoped over the loaded container, after which the total enclosed container is removed from the station. An application entitled "Multi-Station Packaging Machine and Method of Packaging," filed at the same time as this application, discloses a packaging operation for loading a container with layers of fruit in a nested fashion. The equipment to be described herein is that which is capable of taking the loaded container and placing it into a telescoping station where a top is placed in telescoping relation with the loaded container. It can be appreciated, however, that while this is shown in conjunction with a machine for loading fruit, it is readily apparent that such an arrangement can be used in any situation where it is desired to place a box top in telescoping relationship with a loaded container. The utilization in conjunction with the packaging machine used for loading fruit is but one embodiment where the instant invention can be applied.

In accordance with the present invention, a box filled with fruit is disposed in a telescoping station and a box top is moved down into telescoping relation with the filled box. To insure that the box top is telescopingly disposed, the apparatus is designed to spread the box top so it will fit over the loaded box bottom. This is accomplished by resilient fingers which are placed inside the box top and a pressure plate placed on top of the box presses the top down into telescoping relationship with the box bottom. During the downward movement, the spreader assembly, which includes resilient fingers that contact the inner surface of the box top and the outer surface of the box bottom, insures that during the downward movement of the box top, the sides thereof telescope around the outer surfaces of the box bottom. Just prior to the box top reaching the bottom or lower position to which it is being pushed onto the loaded container, the resilient finger spreader assembly is moved out of the way below the platform on which the loaded container is disposed and the completion of the downward movement of the box top takes place.

When the box is in the finished position, it is then moved out of the telescoping station and a subsequent box is moved into position where the steps are repeated.

The invention will be more clearly understood from the following description in conjunction with the attached drawings, in which:

FIG. 4 shows the box top being in place on resilient fingers located within the box and heretofore provided box top shelves moved out of the way so that the box is supported on the spreader assembly;

FIG. 5 is similar to FIG. 4, but shows the presser plate in position to move the box top downwardly;

FIG. 6 is a cross-sectional view showing the fingers disposed inside the box top to provide for the telescoping relationship of the box top to the box bottom;

FIG. 7 is a view similar to FIG. 5, but showing the box top at an intermediate position during the telescoping action;

FIG. 8 is a view similar to FIG. 7 and showing the fingers being removed from the box top to facilitate final movement of the box top;

FIG. 9 is a view similar to FIG. 8 showing the box top in the fully telescoped position;

FIG. 10 is a view similar to FIG. 9, but showing the presser plate removed to permit movement of the fully enclosed box out of the telescoping station;

FIG. 11 is a perspective view of the resilient box spreader assembly;

Figure 12:
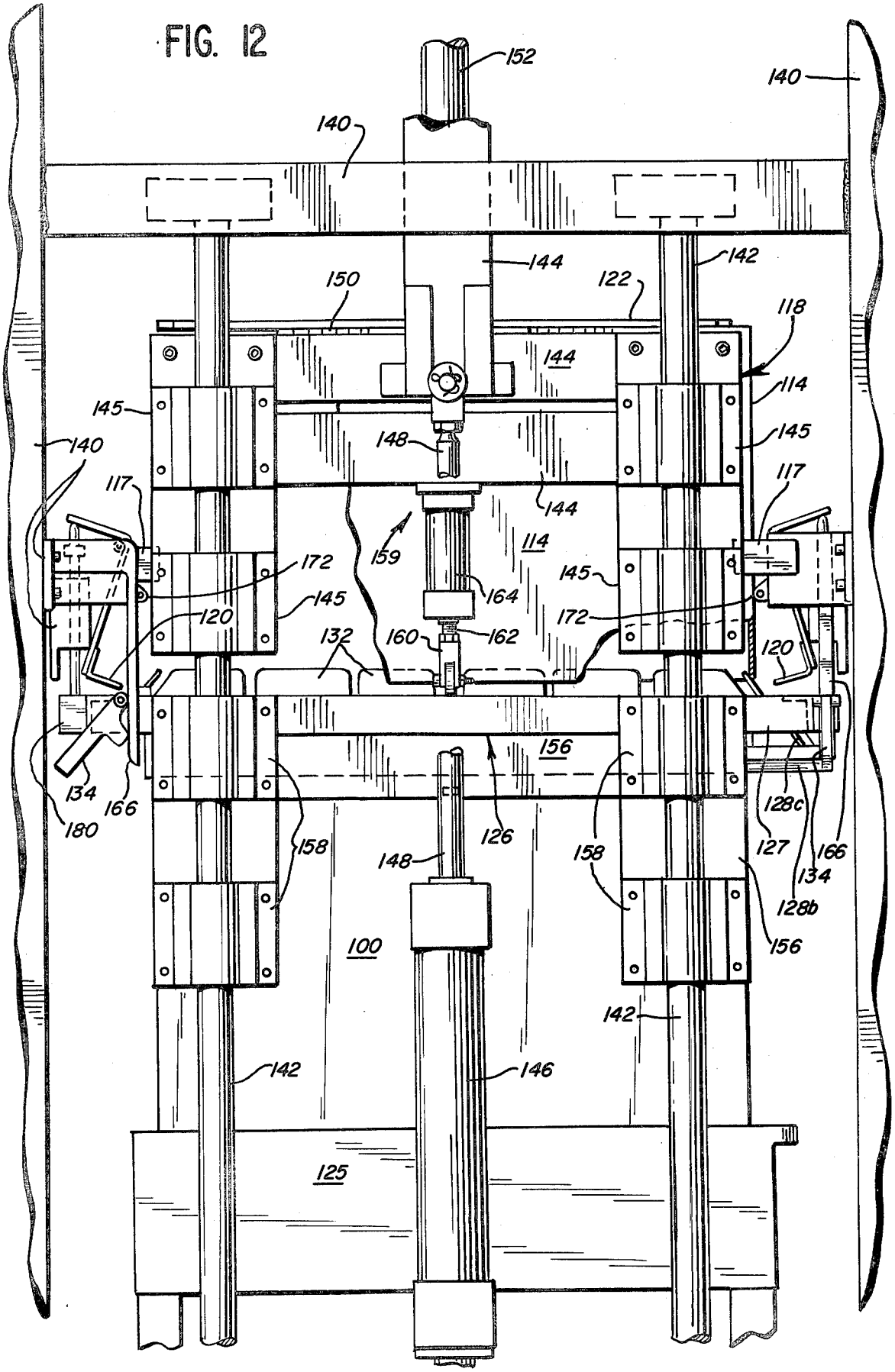
FIG. 12 is a cross-sectional view similar to FIG. 5 taken along line 12—12 of FIG. 5 showing the box in position on the spreader assembly and with the shelves heretofore supporting the box top, but out of engagement therewith.
Figure 12A:
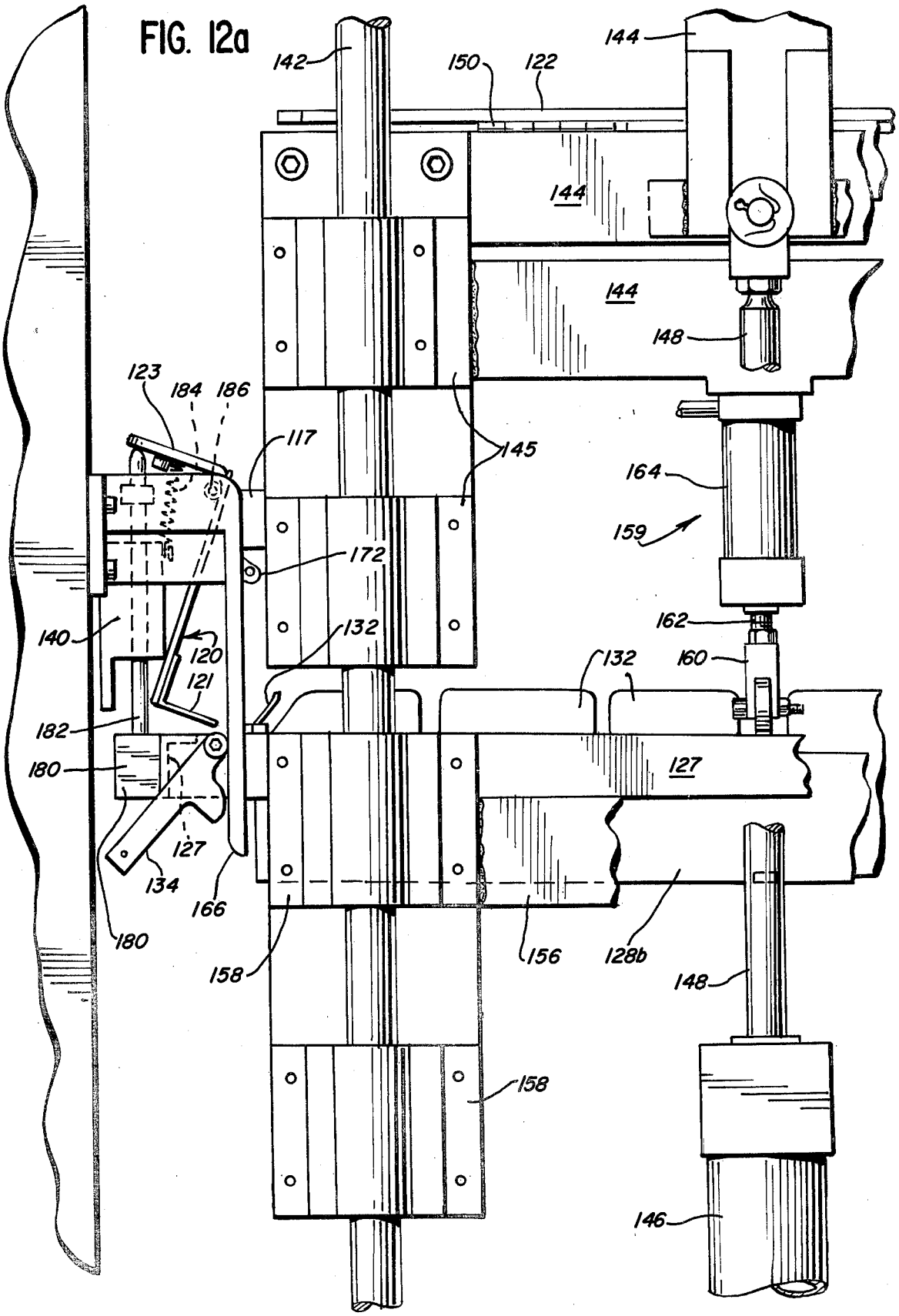
Figure 13:
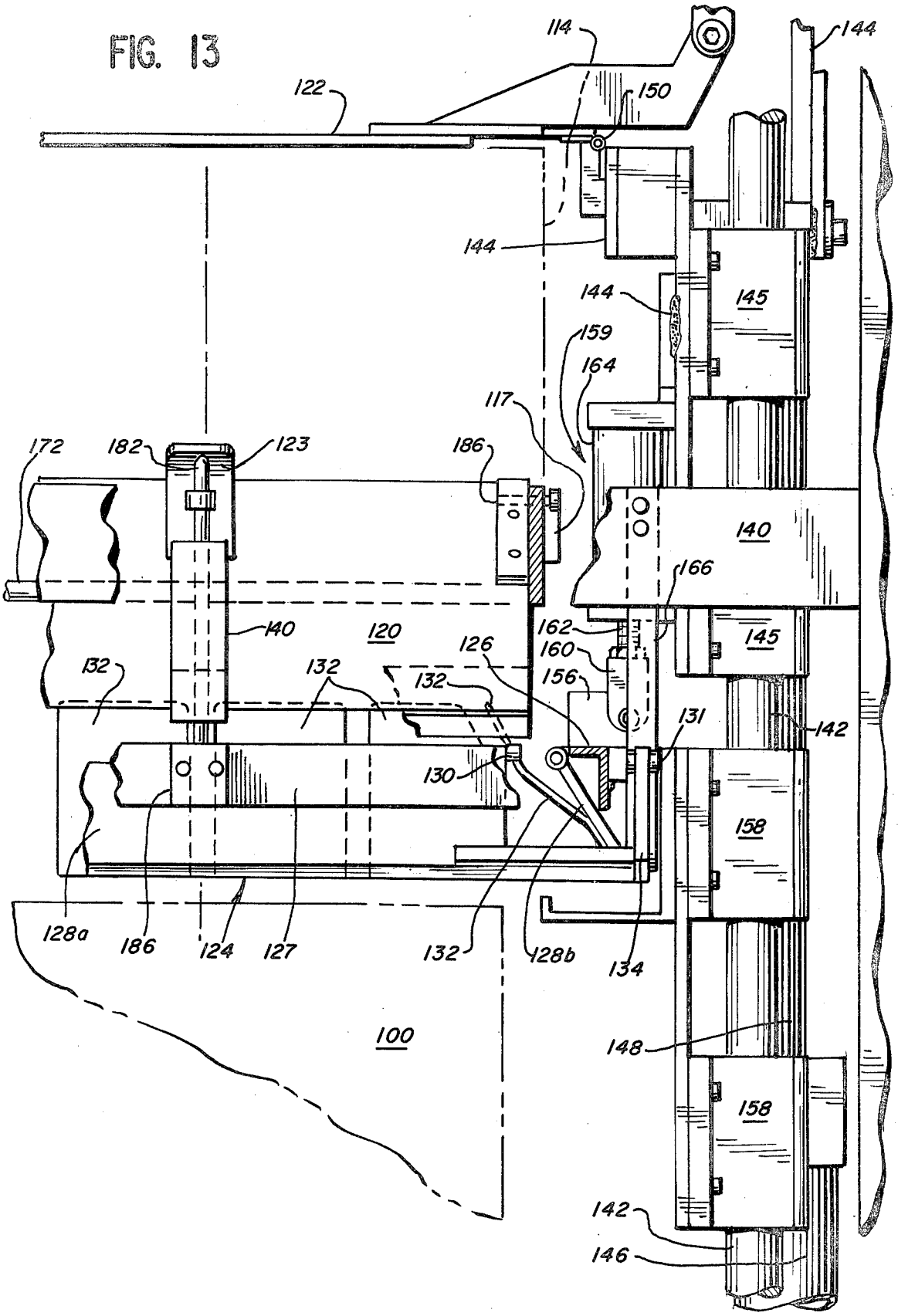
Figure 14:
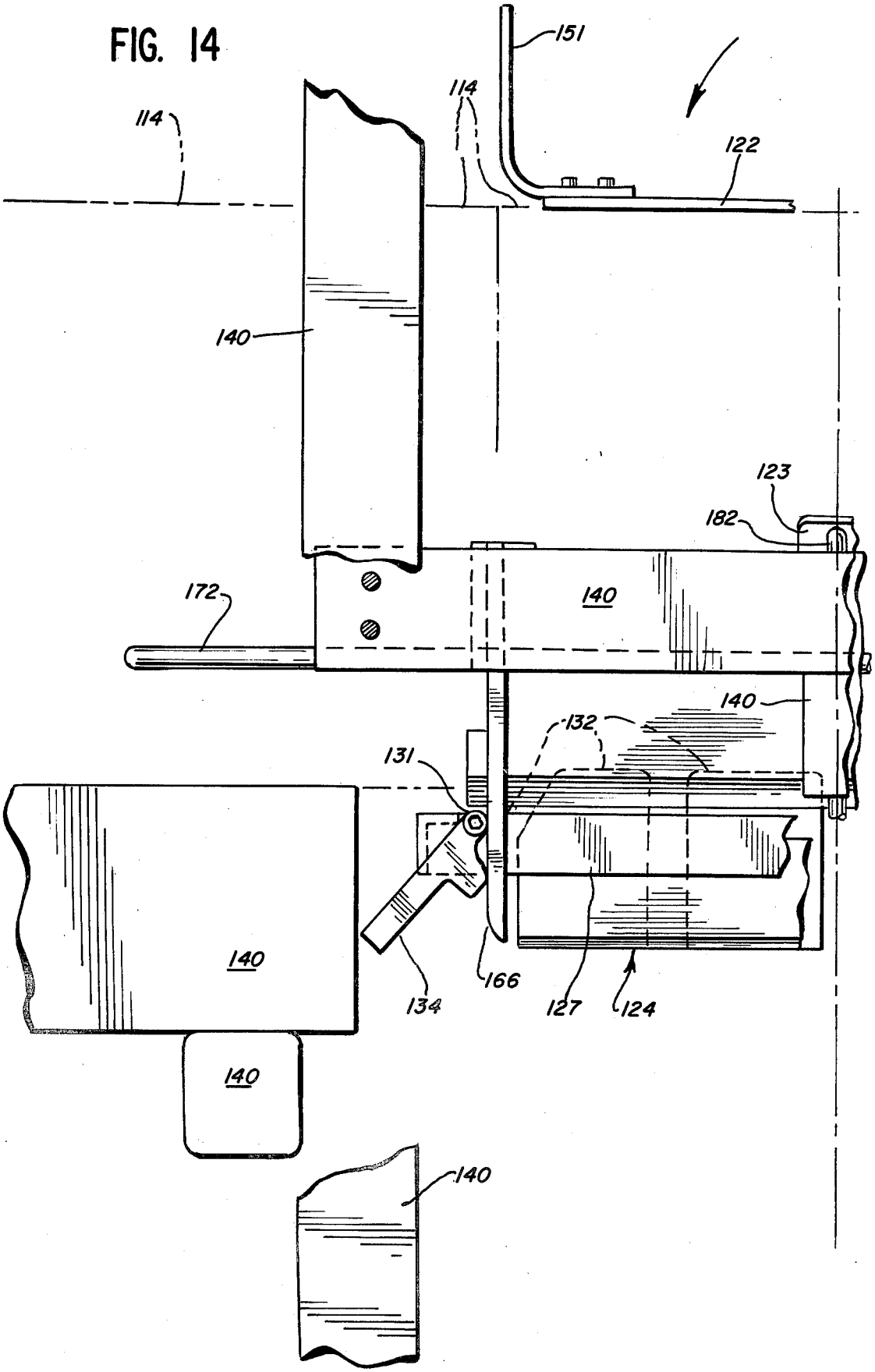
Figure 15:
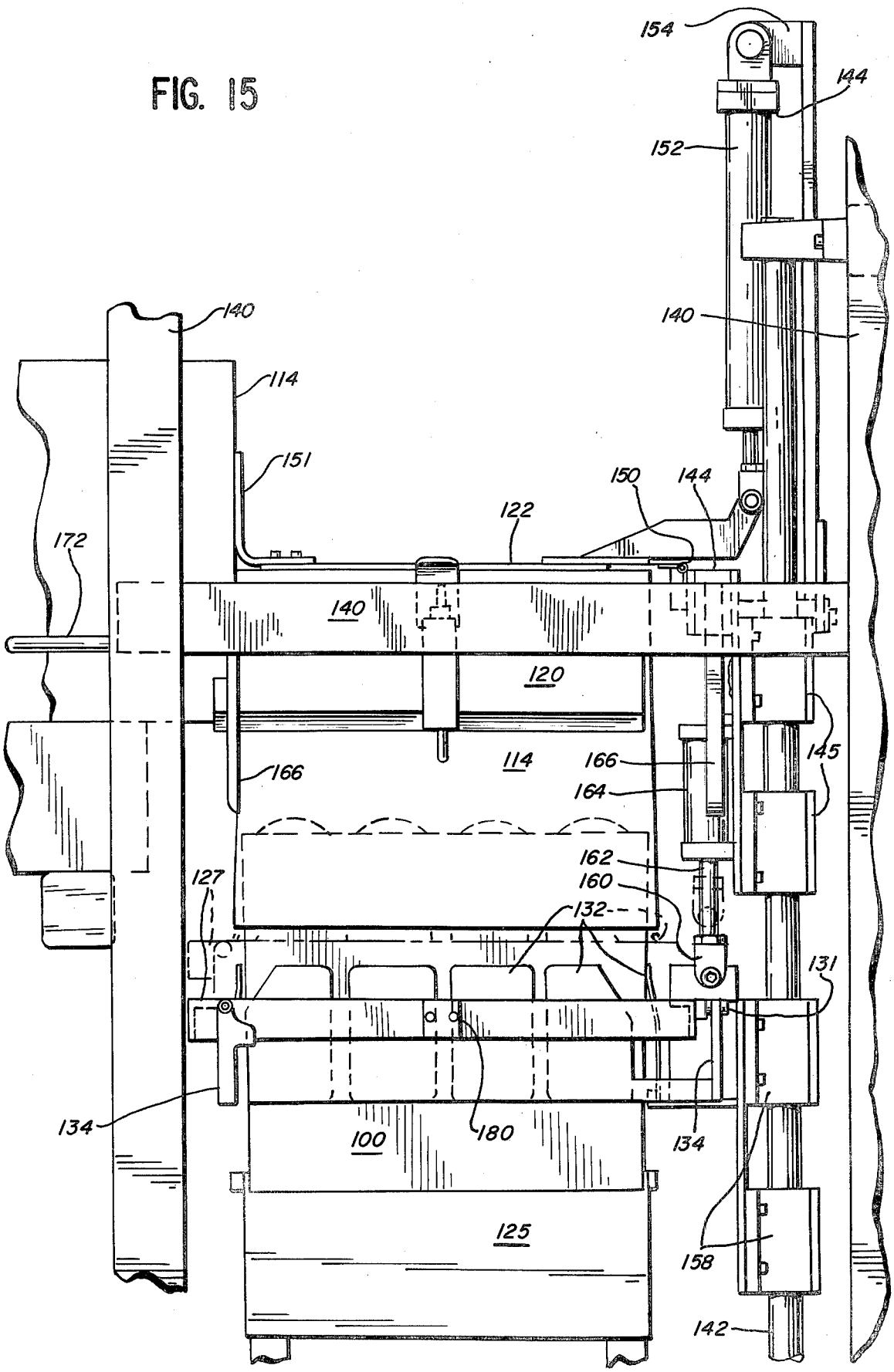
Figure 16:
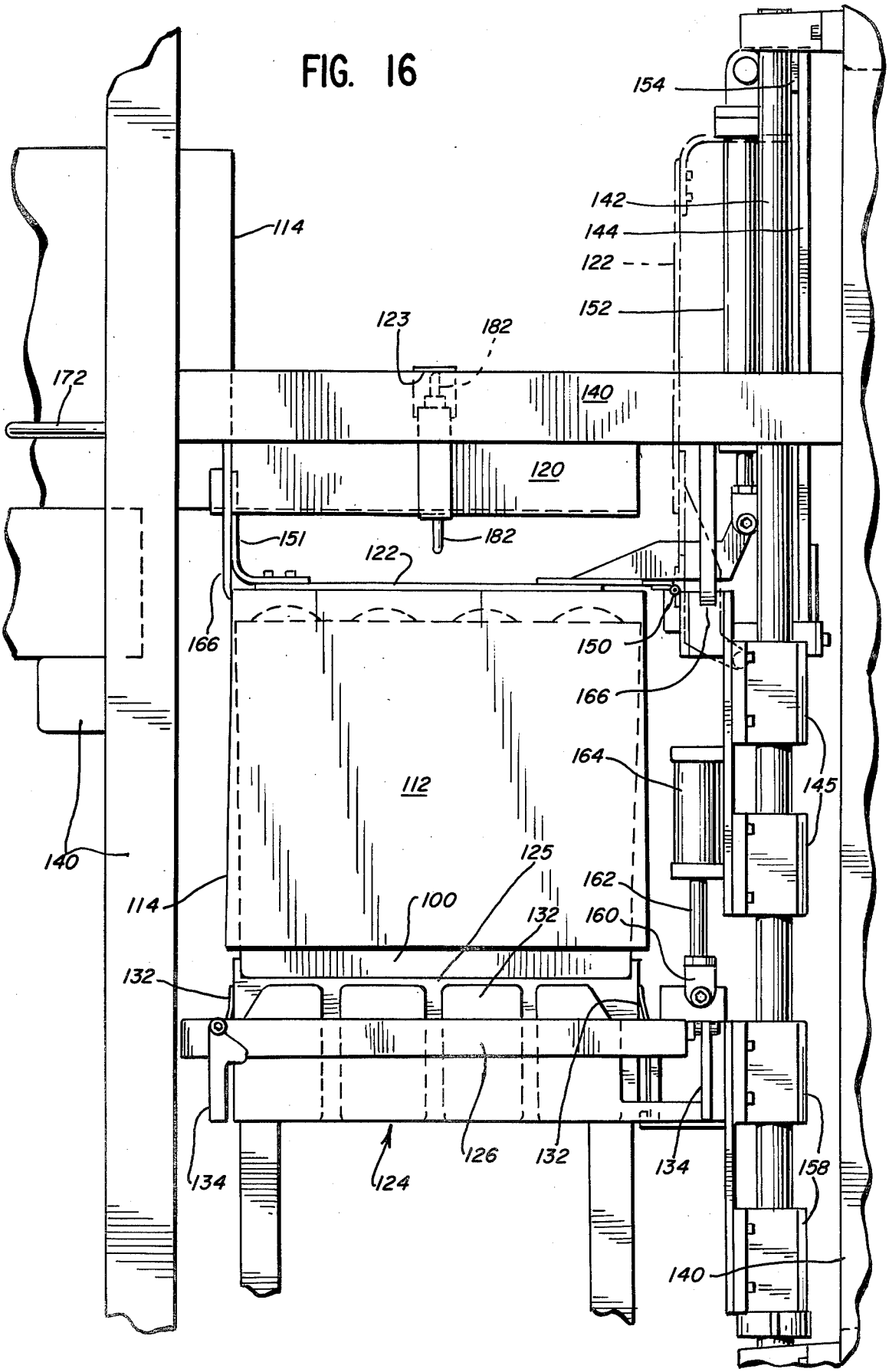

FIG. 12*a* is an enlarged section of the right-hand portion of FIG. 12;

FIG. 13 is a partially broken-away view of the right-hand portion of the mechanism employed for moving the presser plate, box spreader assembly, and other mechanisms taken along line 13—13 in FIG. 5;

FIG. 14 is a partial view showing the left-hand portion of the mechanism of FIG. 13 taken along line 14—14 of FIG. 5;

FIG. 15 is a side elevation view similar to FIG. 8 in that it shows the box top and bottom in telescoping position; with the box spreader assembly moved out of engagement with the box top; and FIG. 16 is similar to FIGS. 9 and 10 taken along line 16—16 in FIG. 9 in that the box spreader assembly has been moved below the platform on which the loaded container is located, and the box is shown in the final telescoped position.

Figure 1:
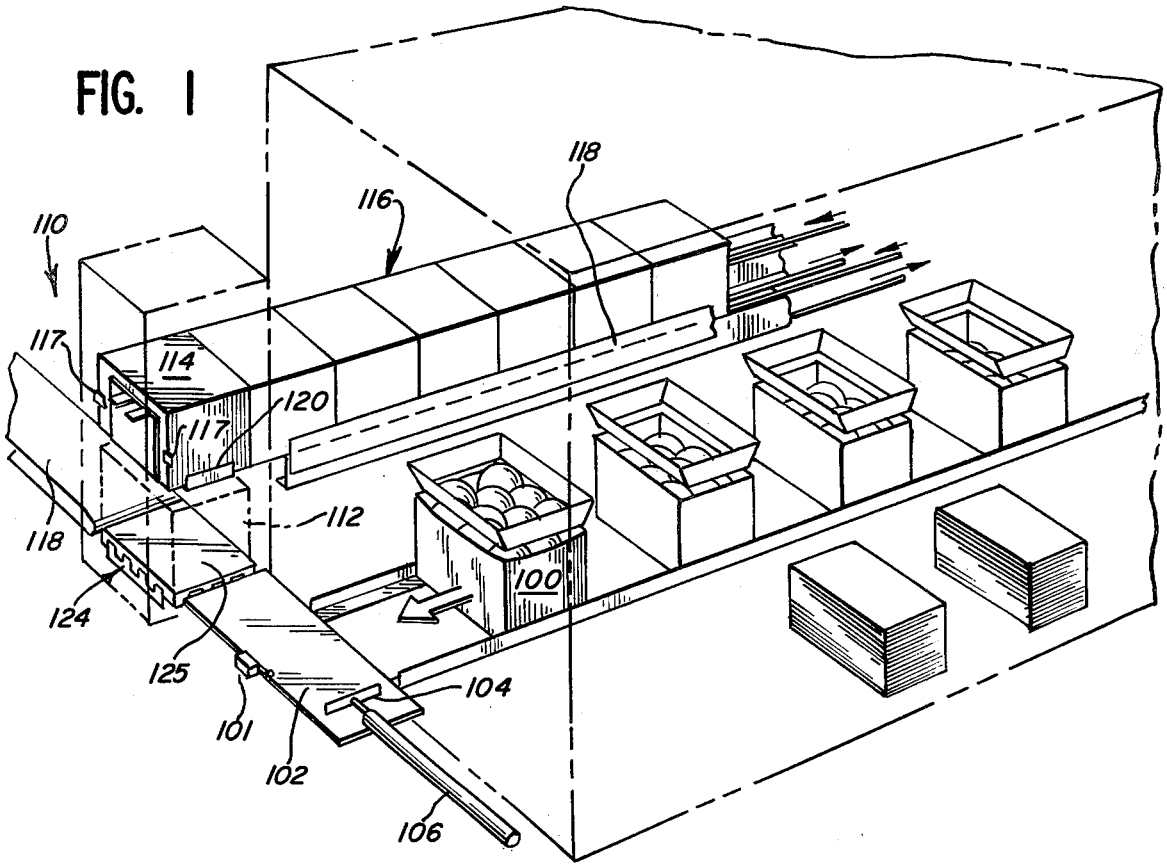
FIG. 1 illustrates a plurality of box tops which are placed in position so that the endmost top is in position to be superimposed on a filled box bottom when placed in the telescoping assembly.

Referring now to FIG. 1, there is illustrated a conveyor in which filled boxes 100 are to be moved against microswitch 101 on platform 102 before they are to be introduced into the telescoping station where a box top comparable in shape but slightly larger than the box bottom is to be telescopingly placed over the box bottom in the telescoping station 110. Details of a machine with which the invention disclosed herein can be used is covered in detail in my application Ser. No. 315,367, entitled "Multi-Station Packaging Machine and Method of Packaging," and filed along with this application. It is to be noted that within the telescoping station 110, there is shown located a fully enclosed container that is to be ejected therefrom and a box top that is to be positioned on a filled container bottom that is to be directed into the telescoping station.

Figure 2:
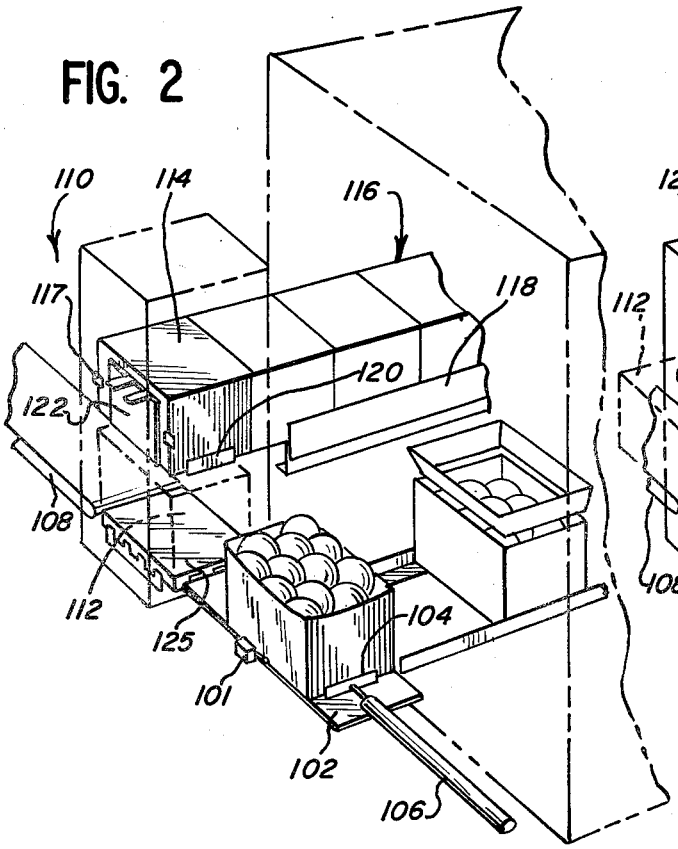
FIG. 2 is a view showing a loaded box bottom prior to being introduced into the telescoping assembly.

Referring now to FIG. 2, the loaded container is shown on the platform 102 and engaged by a push member 104 that is operated by a hydraulic cylinder 106.

Figure 3:
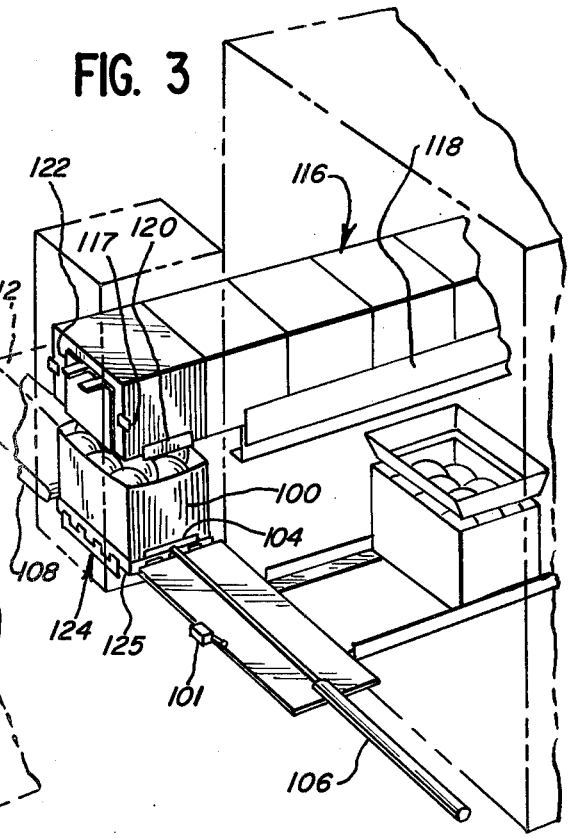
FIG. 3 shows the loaded box within the telescoping assembly about to receive a box top.

In FIG. 3, there is shown the operation of the push rod to move the loaded container 100 into the telescoping station 110 to receive a box top 114, and at the same time force out the completely enclosed container 112 onto a conveyor 108, which will remove the enclosed box. The box top 114 is the end of a row of box tops 116, which top 114 has been directed against the stops 117 and maintained in position in the telescoping station on the tippable shelves 120. It remains to note that in FIGS. 1, 2, and 3, the box top support and spreader assembly 124, which will be described hereinafter, is located below the container support or platform 125 within the telescoping station 110, so it will not interfere with the movement of a loaded container out of the telescoping station, and a new container being directed therein.

Referring now to FIG. 4, there is illustrated a loaded container 120 in the telescoping station 110 in position to receive a box top 114 in telescoping relationship. The presser plate 122 has been raised to a position above the box top and as shown in FIG. 5 has been placed in downward pressing engagement with the box top, and by apparatus described hereinafter will effect the telescoping relationship between the top 114 and the loaded container 112. It is to be noted at this time that the box top support and spreader assembly 124 has been moved up into position to support the box top and that the tipable shelves 120 have been moved out of the way so that the box top can be pressed down into position over the filled container, during which time the spreader assembly will insure that the box top will be telescoped over the filled container.

Following through with the sequence shown in FIGS. 7, 8, 9, and 10, it can be seen that in the various steps illustrated, the box top is being pressed onto the lower container in FIG. 7; FIG. 8 shows the box top approximately half-way down and the spreader assembly moved out of engagement with the box top; FIG. 9 shows the spreader assembly disposed below the platform on which the container 109 is supported; and FIG. 10 shows the telescoping completed and the presser plate raised to receive a subsequent box in the manner shown in FIG. 1.

The box support and spreader assembly 124, which functions to spread the top so that it can be telescoped over the loaded container, is shown in detail in FIG. 11 and consists of a box frame 126 essentially made up of interconnected angle irons 127. Secured to the box frame along each side thereof are longitudinally extending spring support members 128. Each of these support members is secured to one of the sides of the frames 126 by pins 129 which extend through hinges 130 secured to the angle iron 127 within the box frame 126, as shown in FIG. 6, and a pin 131 which interconnects the outer end of a support member 128 to the angle iron exteriorly of the box frame and includes a cam member 134 which when engaged functions to pivot the spring support member 128 about pins 129 and 131 to insure that the springs 132 are properly positioned during the telescoping action within the box top and outside the lower container, as shown in FIG. 6.

The mechanism for controlling the action of the presser plate and for controlling the operation of the box spreader assembly is shown in FIGS. 12-16.

Referring now to FIG. 12, there is illustrated the mechanism for moving the presser plate 122 in compressing action against the top of the box top, controlling the pivotal movement of the presser plate, and effectuating movement of the box lid support and spreader assembly.

Specifically, there is illustrated the main stationary frame member 140 which includes support rods 142. Supported for movement relative to the support rods 142 and main frame member 140 is a movable frame assembly 144 to which is connected the presser plate 122 and the cylinder 152 (see FIG. 15) for operating same. Also connected to the movable frame assembly is a cylinder assembly 159 to which is connected the box spreader assembly. Thus, movement of the movable frame assembly 144 carries along with it the box spreader assembly 124, but when desired the cylinder assembly 159 can be independently operated to move the spreader assembly relative to the movable frame assembly.

The movable frame assembly 144 is supported by bushing supports 145 which surround the support rods 142. The movable frame assembly 144 is operated through the action of a hydraulic cylinder 146 through a piston rod 148 secured to the movable frame assembly 144.

As shown in FIG. 15, the presser plate 122 is pivotally mounted at hinge 150 and is operated between its horizontal and vertical positions by presser plate cylinder 152 which is secured to the movable frame assembly 144 via bracket 154.

As previously mentioned, it is essential that the box spreader assembly 144 be movable relative to the movable frame assembly 124 so that while it will be moved in accordance with the operation of the main cylinder 146 during a substantial portion of the downward travel of the presser plate during the telescoping action of the box top and box bottom, the spreader assembly must be free to move relative to the presser plate so it can be moved out from under the box top so that the spring fingers 132 of the spreader assembly will be below the platform 125 on which the filled container 112 is located to permit movement of the filled and closed container 112 out of the telescoping station.

To this end, the spreader assembly is secured to a spreader assembly support frame 156 which is supported relative to the rods 142 by bushing supports 158. The specific connection between the box frame 126 and cylinder assembly 159 includes support frame 156 and clevis 160 secured to piston rod 162 that is part of cylinder 164, which is in turn connected to the main movable frame assembly 144.

It remains to note that secured to the main frame 140 are four stationary plates 166 which are engaged by the spreader assembly 124 as it is raised to receive the box top. Specifically, the cam plates 134 engage the plates 166 to pivot the spring support members inwardly, as shown in FIGS. 4, 12 and 13, to support the box top.

In addition, there are provided brackets 180 that are secured to the box spreader assembly 124. These brackets are positioned to engage pins 182 which extend through a hole in a main frame member 140 which supports the pins 182. When the box spreader assembly is moved to the position shown in FIG. 12 the pins 182 are engaged and moved to contact a shelf assembly 120 on which the box tops are located and supported when they are directed into the telescoping assembly station. There are two shelves located on opposite sides of the telescoping assembly, as shown in FIG. 12, and these shelves are normally retained in the horizontal position to receive a box by spring 184, which is secured at one end to the main frame 140 and the other end to the undersurface of a bracket 123 of the movable shelf assembly 120. It is noted that the shelf assembly is pivotally mounted at 186 and that when the spreader assembly is in the lower position, the spring 184 biases the shelf portion 121 of the shelf assembly 120 back to the horizontal position to receive a subsequent box top.

METHOD OF OPERATION

Referring to FIG. 3, there is illustrated a loaded container 100 in the telescoping box assembly, which loaded container has been pushed in there by the push member 104 by action of the cylinder 106. When the container 100 is pushed therein, it moves the filled container 112 out of the assembly onto conveyor 108. With the loaded container in the telescoping box assembly, a top 114 is located thereabove on tipable shelves 120. The box top is the end of a row of box tops 116 and is biased against stops 117. It can be seen at this time that the presser plate 122 is in the vertical position adjacent a sidewall of the box top and the spreader assembly 124 is located below the platform 125 on which the loaded container 100 is placed.

In FIG. 4, there is shown the presser plate 122 being raised above the box tops and the spreader assembly located in position with its fingers located inwardly of the box top. During this motion, the spreader assembly engages the shelves 120 to move them out of position and thus the box top is supported on the spreader assembly. Following this, the presser plate is moved into engagement with the top of the box top and the main piston 146 is energized to move the presser plate downwardly along with the spreader assembly into telescoping relationship with the filled box 100. The plate 122 does not push the top 114 all the way down on the filled container 100 to prevent crushing of the fruit. It is important to note that the spreader assembly, which is in engagement with the outer wall of the filled box, guides the box top into telescoping relationship with the loader container 100. After the box top is telescopingly placed into the position shown in FIG. 7, the spreader assembly through the action of the cylinder 164, moves the spreader assembly downwardly out of engagement with the box top, as shown in FIG. 8. The spreader assembly is subsequently moved below the platform and thus the loaded and closed container can be moved out of the telescoping box assembly and a new container moved in to be provided with a box top.

A suitable electrical control system, the details of which are not essential to the understanding of the present invention, is provided for operating the cylinders in the desired sequence.

It is, of course, intended to cover by the appended claims all such embodiments that fall within the true spirit and scope of the invention.

What is claimed is:

1. A machine for telescopingly fitting a box top over a loaded container to from a closed container comprising a main frame, shelf support means for supporting a box top within said machine vertically above said loaded container, a box top spreader assembly, means for moving said box top spreader assembly to release the box top from said shelf support means and retain the box top thereon, means for biasing said box top and box top spreader assembly over said loaded container in telescoping relationship therewith to close said loaded container, and means for moving said box top spreader assembly from said box top after the container is closed to permit removal of the closed container from the machine.

2. A machine as set forth in claim 1 in which the means for biasing said box top and box top spreader assembly includes a presser plate adapted to engage the top of said box top, cylinder means for moving said presser plate and box top spreader assembly downwardly during the container closing action, and means for moving said box top spreader assembly out from under the box top after the container has been closed.

3. A machine as set forth in claim 1 in which the box top spreader assembly includes a rectangular frame structure, a plurality of resilient fingers secured to said rectangular frame structure, said fingers adapted to extend within said box top and exteriorly of the outer wall of said loaded container, whereby during the closing action of the box top relative to the loaded container the box top spreader assembly will insure that the box top conforms to the outer wall of the loaded container as the box top is telescopingly closed over the loaded container.

4. A machine as set forth in claim 3 in which the box top spreader assembly includes means that are engaged by the main frame, whereby when the box top spreader assembly is raised to support the inner wall of the box top, the resilient fingers are directed internally of the box top.

5. A machine as set forth in claim 4 in which the rectangular frame structure includes cam means engaged by the main frame, which interengagement brings about internal movement of said resilient fingers.

* * * * *